US009293832B2

(12) United States Patent
Walpole

(10) Patent No.: US 9,293,832 B2
(45) Date of Patent: Mar. 22, 2016

(54) BROADBAND ANTENNA FEED ARRAY

(71) Applicant: Rantec Microwave Systems, Inc., San Marcos, CA (US)

(72) Inventor: Benjamin F. Walpole, Murrieta, CA (US)

(73) Assignee: Rantec Microwave Systems, Inc., San Marcos, CA (US)

( * ) Notice: Subject to any disclaimer, the term of this patent is extended or adjusted under 35 U.S.C. 154(b) by 0 days.

(21) Appl. No.: 14/500,829

(22) Filed: Sep. 29, 2014

(65) Prior Publication Data

US 2015/0077301 A1 Mar. 19, 2015

Related U.S. Application Data

(63) Continuation of application No. 13/348,498, filed on Jan. 11, 2012, now Pat. No. 8,847,838.

(51) Int. Cl.
*H01Q 13/00* (2006.01)
*H01Q 13/02* (2006.01)
*H01Q 13/08* (2006.01)

(52) U.S. Cl.
CPC ..... *H01Q 13/02* (2013.01); *H01Q 13/0275* (2013.01); *H01Q 13/085* (2013.01)

(58) Field of Classification Search
CPC ..... H01Q 1/13
USPC ..... 343/786, 837, 772; 333/125
See application file for complete search history.

(56) References Cited

U.S. PATENT DOCUMENTS 3,670,268 A * 6/1972 Connerney ..... 333/122
4,905,013 A * 2/1990 Reindel ..... 343/786
5,614,874 A * 3/1997 McCandless ..... 333/125
6,320,554 B1 * 11/2001 Yuanzhu ..... 343/786
6,724,277 B2 4/2004 Holden et al.
6,879,298 B1 * 4/2005 Zarro et al. ..... 343/786
7,646,263 B1 * 1/2010 Ergene et al. ..... 333/137
2011/0050527 A1 3/2011 Anderson et al.

FOREIGN PATENT DOCUMENTS

JP 2004-207856 A 7/2004
JP 2004207856 A * 7/2004
KR 10-2006-0100026 A 9/2006

OTHER PUBLICATIONS

International Search Report and Written Opinion for related international application No. PCT/US2013/020811, mailed on Apr. 29, 2013, in 11 pages.
Q-par Angus Ltd, High power horn antenna, Dec. 6, 2009, 3 pages.

* cited by examiner

*Primary Examiner* — Huedung Mancuso
(74) *Attorney, Agent, or Firm* — Procopio, Cory, Hargreaves & Savitch LLP

(57) ABSTRACT

A microwave antenna suitable for monopulse radar applications is operable over a broad frequency band. The antenna uses a horn with two walls. Each wall includes two ridges that extend into an inner region of the horn near the horn's base and then taper into the wall surfaces. The horn is coupled to two ridged waveguide sections with the ridges of the waveguide sections matched to opposed pairs of the horn ridges. The antenna may be coupled to electronics via standard waveguides. In many embodiments, dimensions of the waveguides coupled to the horn are smaller (to provide a small array spacing) than dimensions of the standard waveguides with a tapered waveguide section providing a transition. In one embodiment, the antenna operates with frequencies from 5.25 to 10.5 GHz.

12 Claims, 10 Drawing Sheets

BROADBAND ANTENNA FEED ARRAY

CROSS-REFERENCE TO RELATED APPLICATIONS

This application is a continuation of U.S. patent application Ser. No. 13/348,498 entitled "BROADBAND ANTENNA FEED ARRAY", filed Jan. 11, 2012, which is hereby incorporated by reference.

BACKGROUND

This invention is related to antennas and to an antenna feed array for broadband operation at microwave-frequencies.

Reflector antennas are widely used, particularly for microwave frequency radio waves. Reflector antennas include a reflector and a feed. The reflector commonly has a parabolic shape.

The feed couples radio waves reflected by the reflector to and from electronics. The radio waves are transmitted and received from a part of the feed located at or near the focus of the reflector.

Radar systems commonly use reflector antennas. The monopulse radar technique uses sum and difference signals corresponding to offset beams, that is, beams that originate from the same point but that are slightly divergent. Processing the sum and difference signals provides accurate direction detection. Accordingly, controlling the direction and pattern of the beams is important to the performance of a radar system. Radar systems may use different frequencies, for example, to differentiate materials that differently reflect or absorb different frequencies. Thus, a broadband antenna that operates over a wide frequency band is desirable. Controlling the beams patterns is increasingly difficult as the operating bandwidth increases.

SUMMARY

Broadband antenna feed arrays, systems for their use, methods for their use, and methods for their design are provided. In one aspect, the invention provides a broadband antenna including a body having opposing arms arranged for coupling electromagnetic signals to electronics at each distal end and a medial leg arranged for coupling to radiating signals, the body comprising two waveguide paths; and a horn for transmitting and receiving the radiating signals, the horn coupled to the two waveguide paths and including an upper horn wall; and a lower horn wall, each horn wall comprising a plate with two horn ridges extending from a base of the horn and projecting toward an inner region of the horn.

In another aspect, the invention provides a broadband antenna including a first waveguide path including a transition waveguide section for coupling electromagnetic signals to electronics and arranged for transitioning a first waveguide cross-section to a second waveguide cross-section, a bend waveguide section coupled to the transition waveguide section and arranged for turning a propagation direction of the electromagnetic signals, and a horn waveguide section coupled to the bend waveguide section, the horn waveguide section having the second waveguide cross-section; a second waveguide path including a transition waveguide section for coupling electromagnetic signals to electronics and arranged for transitioning the first waveguide cross-section to the second waveguide cross-section, a bend waveguide section coupled to the transition waveguide section and arranged for turning a propagation direction of the electromagnetic signals, and a horn waveguide section coupled to the bend waveguide section, the horn waveguide section having the second waveguide cross-section; and a horn operable to transmit and receive radiating signals, the horn coupled to the horn waveguide section of the first waveguide path and the horn waveguide section of the second waveguide path, the horn comprising an upper horn wall and a lower horn wall, each horn wall having two ridges extending from a base of the horn and projecting toward an inner region of the horn.

In another aspect, the invention provides a broadband antenna including a horn for transmitting and receiving radiating signals, the horn including an upper horn wall; and a lower horn wall, each horn wall comprising a generally rectangular plate with two horn ridges extending from a base of the horn and projecting toward an inner region of the horn, the horn ridges being arranged for coupling to a ridged waveguide.

Other features and advantages of the present invention should be apparent from the following description which illustrates, by way of example, aspects of the invention.

BRIEF DESCRIPTION OF THE DRAWINGS

The details of the present invention, both as to its structure and operation, may be gleaned in part by study of the accompanying drawings, in which like reference numerals refer to like parts, and in which.

DETAILED DESCRIPTION

Figure 1:
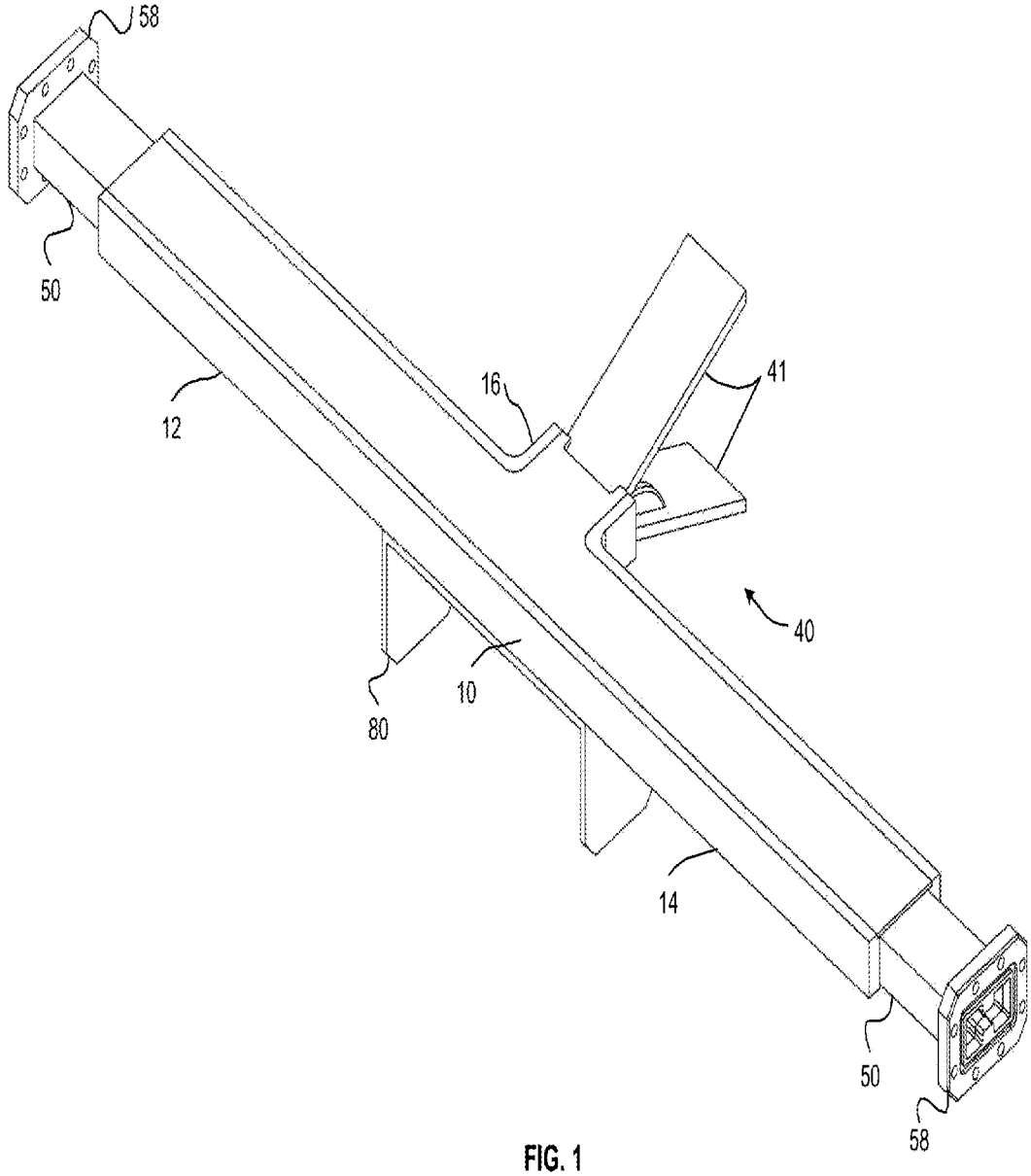
FIG. 1 is a perspective view of an antenna feed in accordance with aspects of the invention.

FIG. 1 is a perspective view of an antenna feed. The antenna feed may be used to feed a parabolic reflector. The antenna feed may also be used without a reflector. Two slightly offset beam patterns are produced by the antenna feed so that it may be used in monopulse radar applications. The antenna feed operates over a wide range of frequencies. In an exemplary embodiment, the antenna feed operates from 5.25 GHz to 10.5 GHz.

References to directions, such as left/right and top/bottom are for descriptive purposes and should not be taken to imply any particular orientation of the devices described. Additionally, when numerical dimensions are given, it should be understood that they are for exemplary embodiments that operates over particular frequency ranges and that the invention encompasses devices of other dimensions. Dimensions are generally scaled in proportion to wavelengths to achieve devices that operate at other frequencies. The antenna feed may be used as a transmitter, a receiver, or both. For concise description, operation of the antenna feed is described for operation as a transmitter. Operation as a receiver may be understood as the inverse of operation as a transmitter.

Figure 2:
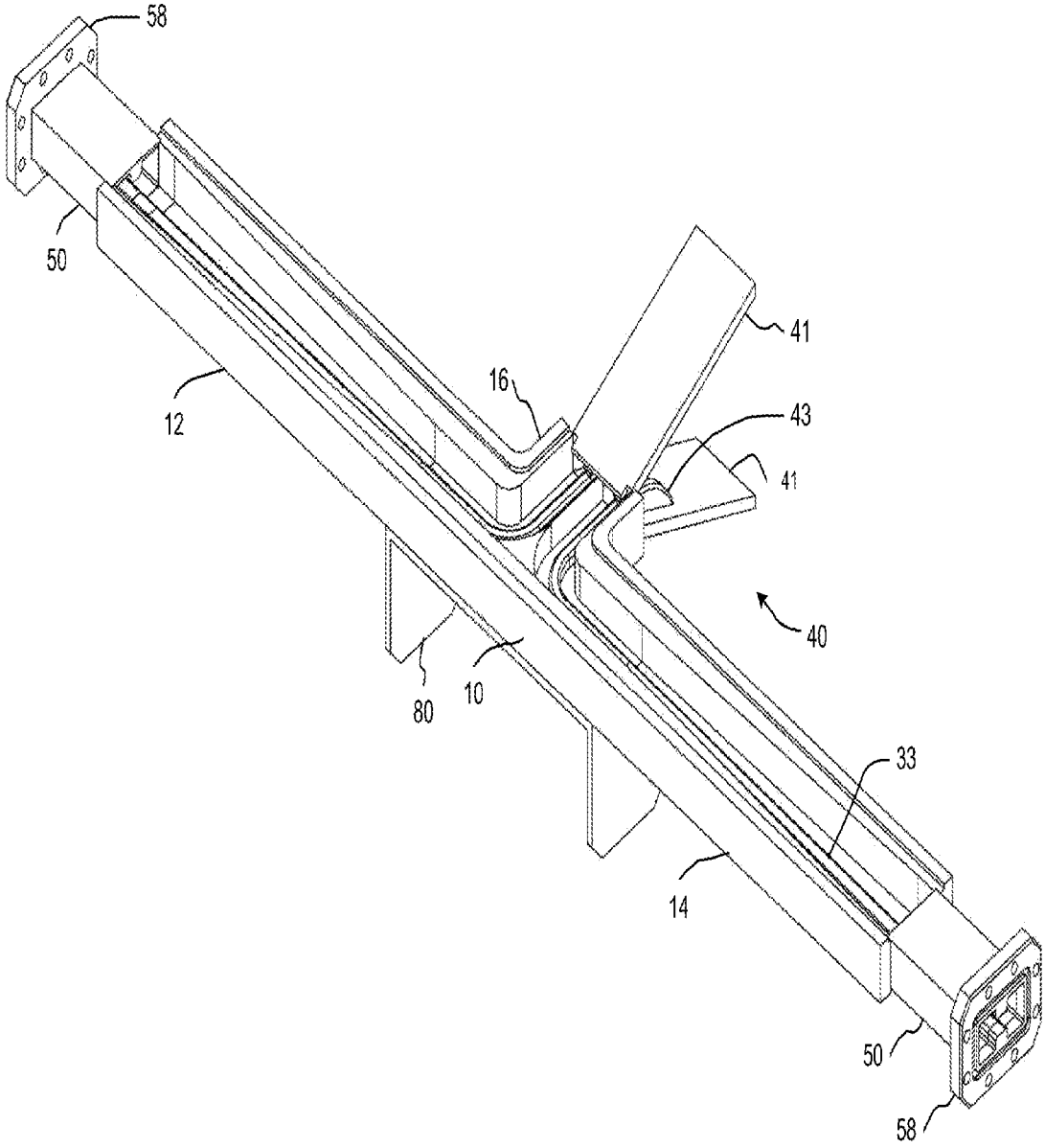
FIG. 2 is a cutaway perspective view of the antenna feed of FIG. 1.
Figure 3:
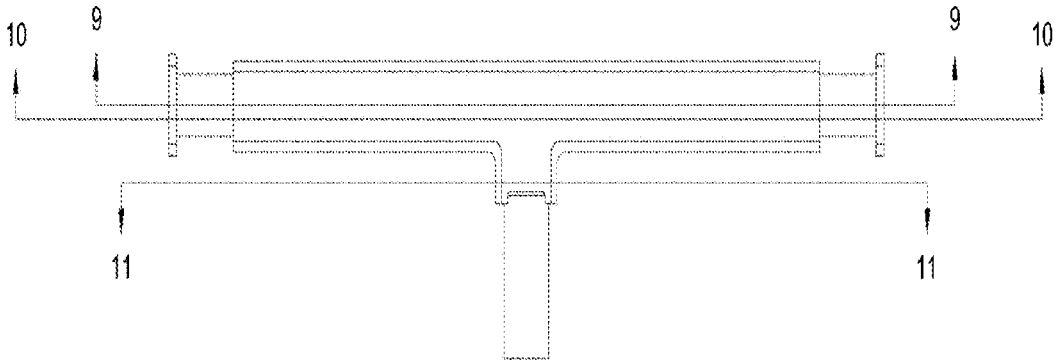
FIG. 3 is a top view of the antenna feed of FIG. 1.
Figure 4:
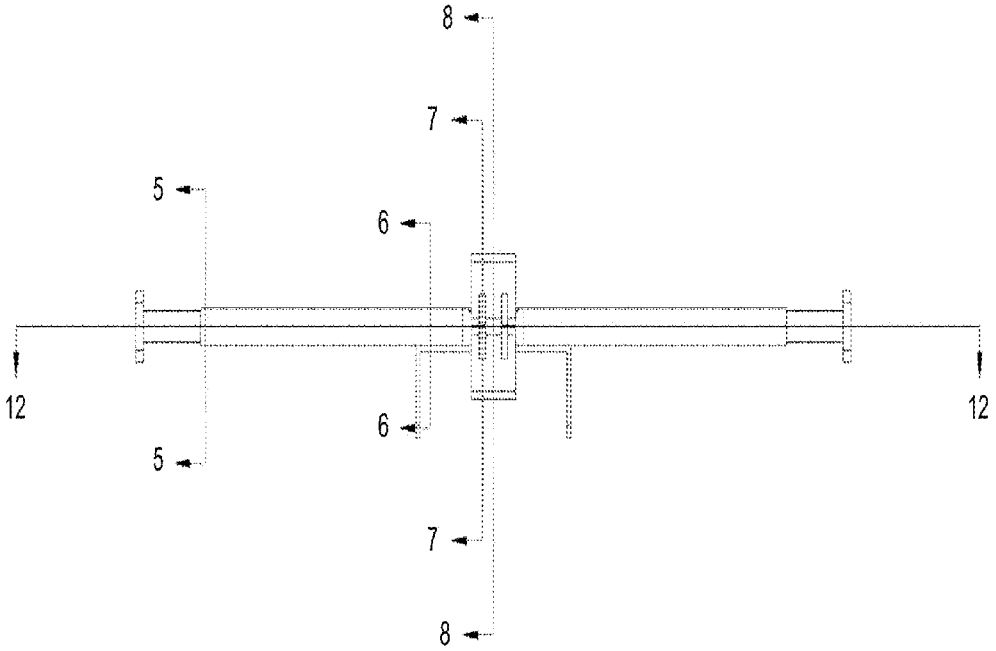
FIG. 4 is a front view of the antenna feed of FIG. 1.
Figure 5:
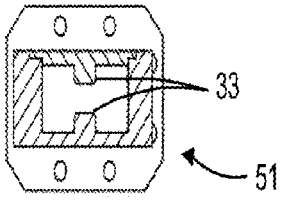
FIGS. 5-12 is a cross-sectional views taken along corresponding section lines indicated in FIGS. 3 and 4.

FIGS. 1-12 illustrate various aspects of the antenna feed. FIG. 1 is a perspective view; FIG. 2 is cutaway perspective view; FIG. 3 is a top view; FIG. 4 is a front view; and FIGS. 5-12 are cross-sectional views. Although the antenna feed will be described with reference to the figures collectively, some specific references to figures are given to assist in understanding the description.

As shown in FIG. 1, the antenna feed includes left and right interface sections 50. The interface sections 50 are for coupling to electronics, such as, microwave transmitters and receivers. The antenna feed may be coupled to electronics, for example, in a monopulse application via a magic tee. A horn 40 transmits or receives radiating signals. A body 10 of the antenna feed couples the interface sections 50 to the horn 40. The body 10 is generally T-shaped with opposing first and second arms 12, 14 ending at the interface sections 50 and a medial leg 16 protruding from the intersection of the two arms to the horn 40. In an embodiment, a bracket 80 is attached to a lower surface of the body 10, for example, for mounting the antenna feed to a reflector.

The interface sections 50 are ridged waveguides. The interface sections 50 have a rectangular cross-section. Ridges 33 extend inward from a middle portion of each of the long walls of the interface sections 50. The ridges 33 have a generally rectangular shape. The edges may be chamfered or rounded in the illustrated embodiment. The use of ridged waveguides can provide a wider frequency range compared to rectangular waveguides. To ease coupling to electronics, the interface sections 50 may have a cross-section that matches a standard waveguide. The standard waveguide may be according to the Waveguide Rectangular Double-ridge series of Mil. Std. MIL-W-23351. In the exemplary embodiment, the cross-section matches a WRD475 waveguide. Accordingly, the interface sections 50 have an internal width of 1.09 inches, an internal height of 0.506 inches, a ridge width of 0.272 inches, and a ridge spacing (separation between upper and lower ridges) of 0.215 inches. Each interface section 50, in the shown embodiment, includes a flange 58 for fastening the antenna feed to waveguides for coupling to electronics.

The body 10 includes two waveguide paths that couple the interface sections 50 to the horn 40. Each of the two waveguide paths includes a series of waveguide sections that form the two arms 12, 14 and the medial leg 16 of the body 10. The series of waveguide sections form continuous, ridged waveguides. The shape and direction of the waveguide paths vary over their lengths. However, in an embodiment, the two waveguide paths are symmetric. First waveguide sections 51 (FIG. 12) are located near the interface sections 50 and have cross-sections matching that of the interface sections 50. The first waveguide sections 51 may be short, for example, about one-half inch long. In some embodiments, first waveguide sections 51 are omitted or of only an incremental length. The first waveguide sections 51 are collinear at opposing ends of the body 10.

Horn waveguide sections 54 are located in the medial leg of the body 10 and are coupled to the horn 40. The horn waveguide sections 54 have a smaller cross-section than the first waveguide sections 51. In the illustrated embodiment, the cross-section of the horn waveguide sections 54 is a scaled version of the cross-section of the first waveguide sections 51. The small size of the horn waveguide sections 54 allows close spacing of the two sections. The horn waveguide sections 54 also have ridges that more closely spaced than the ridges in the first waveguide sections 51. Closer ridge spacing results in electric fields that are heavily concentrated between the ridges thereby lowering the cutoff frequency of the horn waveguide sections 54. This aids operation at lower frequencies which may otherwise be lost with the small cross-section of the horn waveguide sections 54. In the exemplary embodiment, the horn waveguide sections 54 have an internal width of 0.7 inches, an internal height of 0.325 inches, a ridge width of 0.190 inches, and a ridge spacing of 0.04 inches.

The two horn waveguide sections 54 are separated by a common center wall 55. The array spacing of the antenna feed substantially equals the spacing between centers of the two is horn waveguide sections 54. The common center wall 55, in an embodiment, is provided by a metal plate disposed in slots in corresponding portions of the body 10. A metal plate of a different thickness may be used to provide a common center wall 55 of different thickness and thereby provide a different array spacing. Accordingly, similar antenna feed implementations with different array spacing are readily produced. In the exemplary embodiment, the thickness of the common center wall 55 is 0.02 inches thereby providing an array spacing of 0.72 inches. Thus, both the internal widths of the horn waveguide sections 54 and the array spacing may be less than one-half wavelength for some operating frequencies.

Bend waveguide sections 53 are used to turn the direction of the horn waveguide sections 55 to the direction of the first waveguide sections 51. The radius of the bend may be chosen to avoid reflections and based on desired sizes of the body 10. In the exemplary embodiment, the bend waveguide sections 53 have a medial radius of 0.65 inches. Additionally, in other embodiments, the bend waveguide sections may turn an angle greater or less than 90 degrees.

Transition waveguide sections 52 are located in the arms of the body 10. The transition waveguide sections 52 couple the bend waveguide sections 53 to the first waveguide sections 51. Since the cross-sections of the bend waveguide sections 53 and the first waveguide sections 51 differ, the transition waveguide sections 52 are tapered to gradually change the cross-sectional shape. In the illustrated embodiment, a linear taper is used. Other taper shapes may also be used.

The length of the transition waveguide sections 52 may be several wavelengths. In the exemplary embodiment, the length of the transition waveguide sections 52 is 6.5 inches. The dimensions of the of transition waveguide sections 52 may be designed empirically, for example, using finite-element analysis. A too short taper may result in a voltage standing wave ratio (VSWR) that is too large.

In some embodiments, sections of the body 10 may be omitted, combined, or added. For example, when the bend waveguide sections 53 and the first waveguide sections 51 have the same cross-sections, the transition waveguide sections 52 may be omitted. In another example, the bend waveguide sections 53 may be tapered similar to the transition waveguide sections 52.

The horn 40 is located adjacent the horn waveguide sections 55. The horn 40 directs radiation from the antenna feed. The horn 40 includes two horn walls 41. Each horn wall 41 is generally a rectangular plate. In the exemplary embodiment, the horn walls 41 are approximately 3.2 inches by 1.5 inches and diverge at 40 degrees. Each horn wall 41 has two horn ridges 43. The horn ridges 43 are aligned with the ridges of the horn waveguide sections 54. In contrast to common antenna horns, the horn 40 does not include H-plane, or vertical, walls, which are used to shape the antenna pattern.

The shape and position of the horn ridges 43 are selected to control the antenna pattern of the present antenna. The electric fields of the electromagnetic signals near the base of the horn are concentrated between the horn ridges 43. The electromagnetic signals will begin to radiate when the ridges are sufficiently separated, for example, approximately one-half wavelength.

Figure 7:
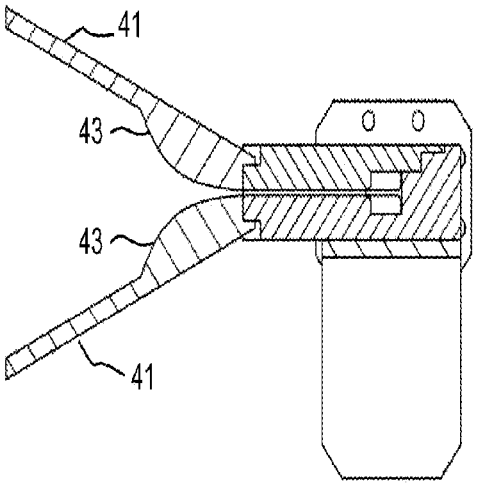
Figure 6:
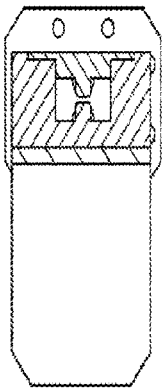
Figure 8:
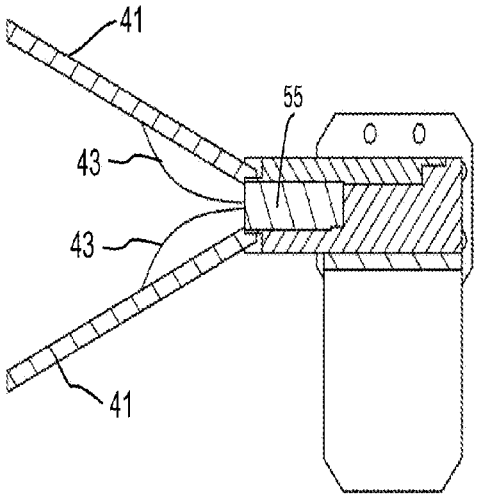
Figure 9:
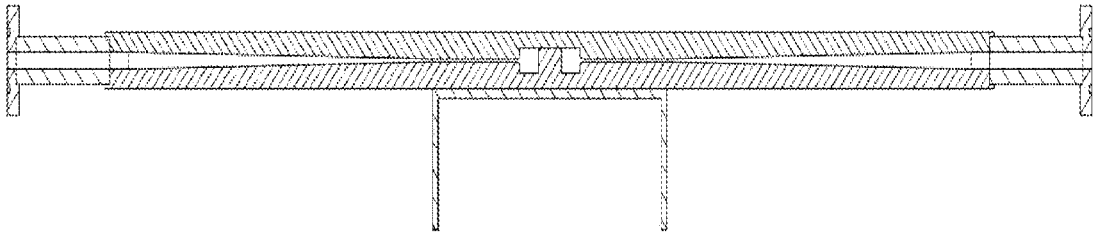
Figure 10:
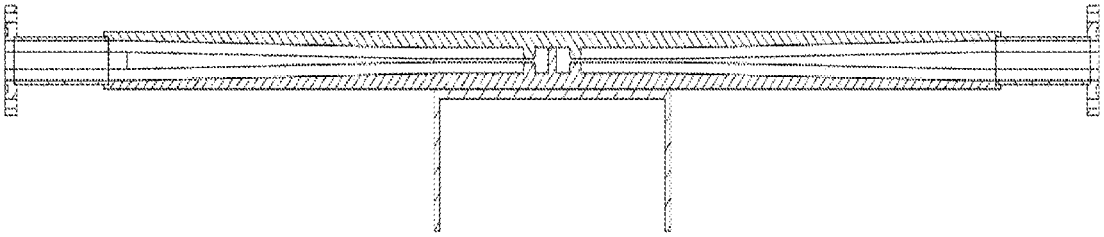
Figure 11:
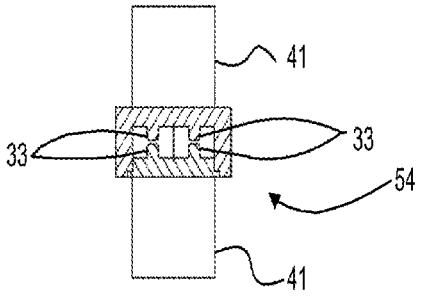
Figure 12:
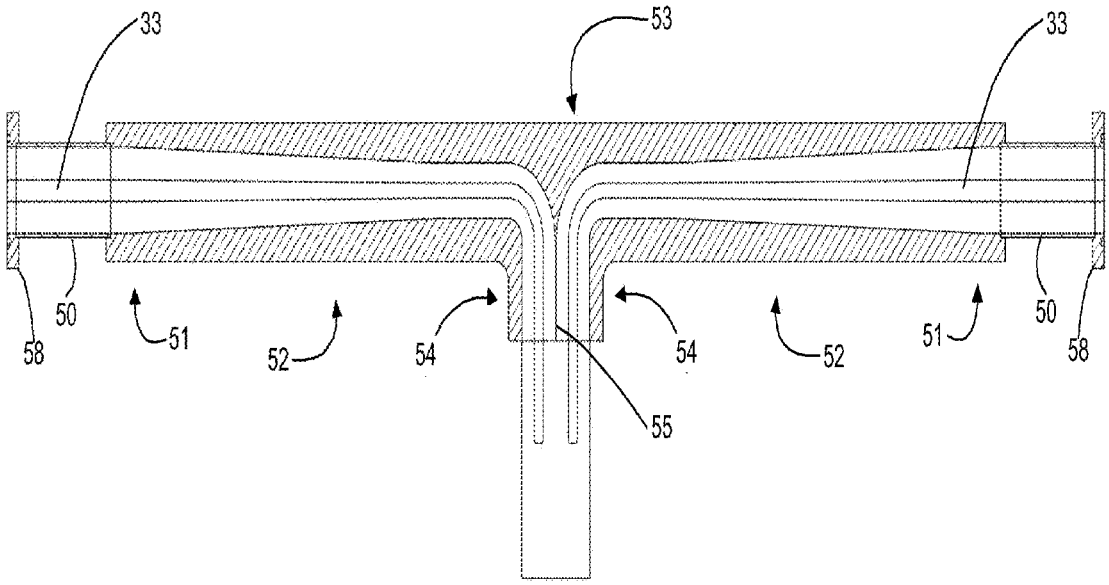

The horn ridges 43 begin adjacent to the ridges of the horn waveguide section 54 (FIG. 7) with a shape that matches the shape of the ridges of the horn waveguide section 54. The horn ridges 43 taper into the inward facing surfaces of the horn plates 41. The horn ridges 43 have a length, in the exemplary embodiment, of approximately 1.5 inches and end near the midpoint of the horn plate 41 in the illustrated embodiment. The outer edge of the ridges may have an arcuate shape as seen in FIG. 7. The shape and length of the horn ridges 43 may be determined empirically to provide a desired combination of antenna pattern and VSWR at the operating frequencies of the antenna.

The ridges in a traditional ridged horn provide a smooth impedance transition from system impedance (commonly 50 ohms) to free space impedance (377 ohms). The ridges terminate when the horn walls are sufficiently spaced to support dominant mode propagation. The radiation pattern is then still controlled by the horn aperture. Because the bandwidth of the described antenna is so large, a horn cannot be made using traditional methods and still be arrayed with the correct spacing. To overcome this sidewalls of the horns have been removed. Since the sidewalls of the horns have been removed, the traditional method of using the horn aperture to control the radiation pattern has been eliminated. By changing the taper length and height, both the VSWR and radiation pattern can be specifically tailored to meet different requirements.

In the illustrated embodiment, the horn is not loaded with a dielectric material. Although loading with a dielectric material lowers the operating frequency of the antenna, it may also result in an unworkably high VSWR at the free space-dielectric material interface. As shown in the illustrated embodiment, the horn ridges end well inside the horn. Extending the ridges to or beyond the outer edge of the horn can result in out of phase energy in the antenna pattern.

The antenna feed, in an embodiment, is made of aluminum. Alternatively, it may be made of another suitable conductive material. The antenna feed may be fabricated, for example, by CNC machining and soldering.

Figure 13:
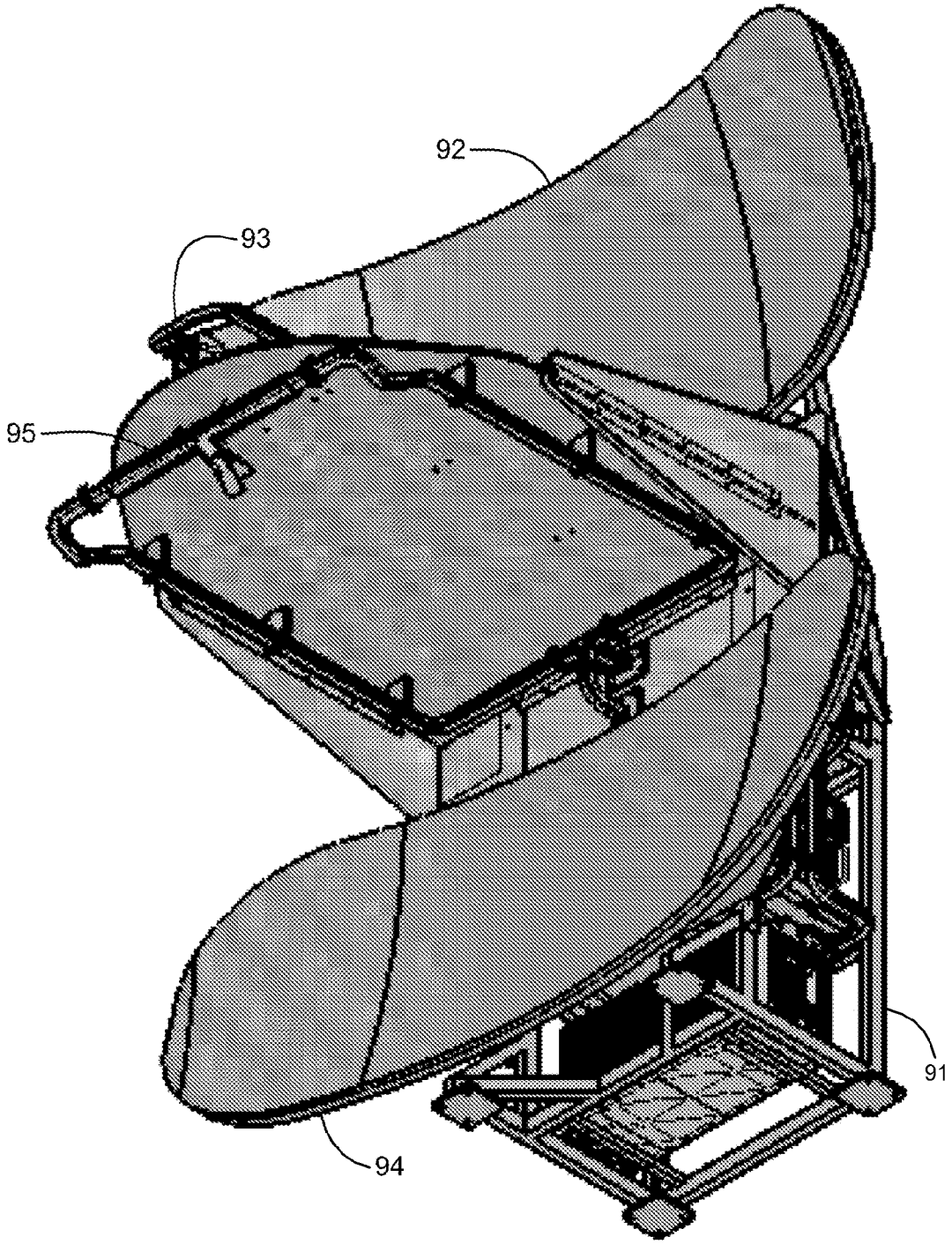
FIG. 13 is a view of an antenna system in accordance with aspects of the invention.

FIG. 13 is a diagram of a radar system. Antenna elements of the radar system are mounted to a support 91. The support 91 may include drive mechanisms for positioning the antenna elements. The support 91 may also be operable to fold elements of the radar system in storage positions, for example, for transporting a mobile implementation of the radar system. The antenna elements of the radar system include an upper reflector 92 and an associated upper feed 93. The radar system also includes a lower reflector 94 and an associated lower feed 95. The lower feed 95 is, in the illustrated embodiment, the antenna feed of FIGS. 1-12. Electronics coupled to the upper feed 93 and the lower feed 95 may also be mounted to the support 91. In an embodiment, the electronics provides monopulse radar operation. Accordingly, a pulse may be transmitted from the upper feed 93 and received by the lower feed 95. The electronics may form sum and difference signals of signals from the left and right antenna feed interfaces to determine the direction of arrival of the return pulse.

The antenna feed of FIGS. 1-12 may be used without a reflector, for example, when the beam focusing provided by the reflector is not required. Additionally, embodiments of the antenna may a single element for non-monopulse applications.

Figure 14A:
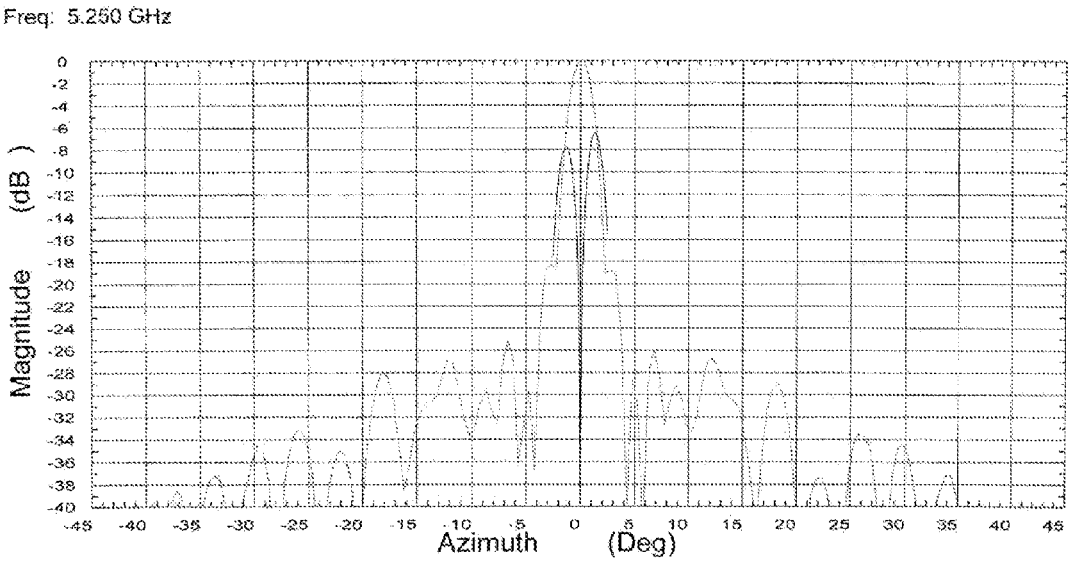
FIGS. 14A-F are diagrams of radiation patterns in accordance with aspects of the invention.
Figure 14B:
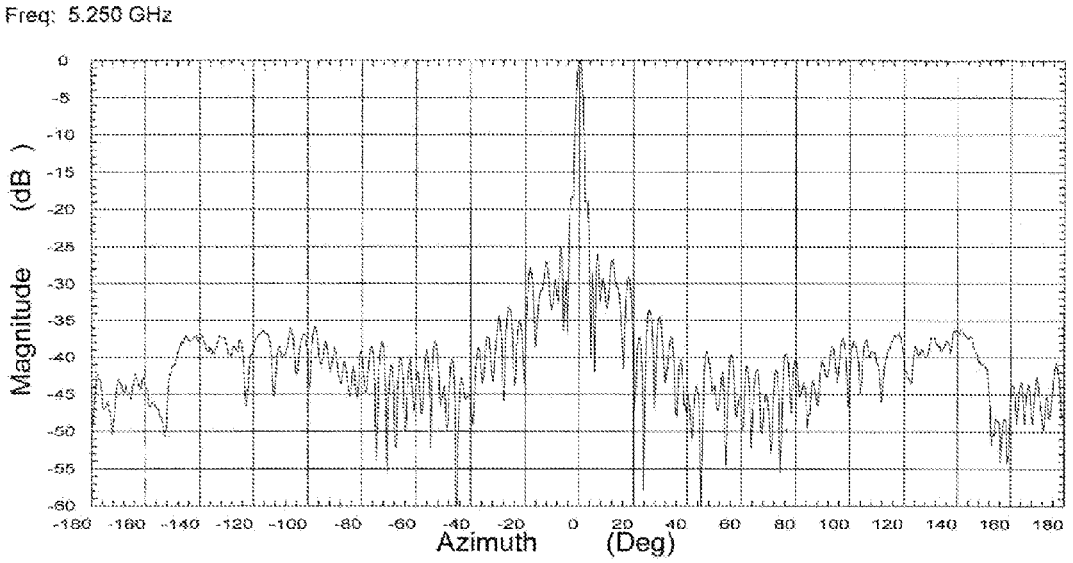
Figure 14C:
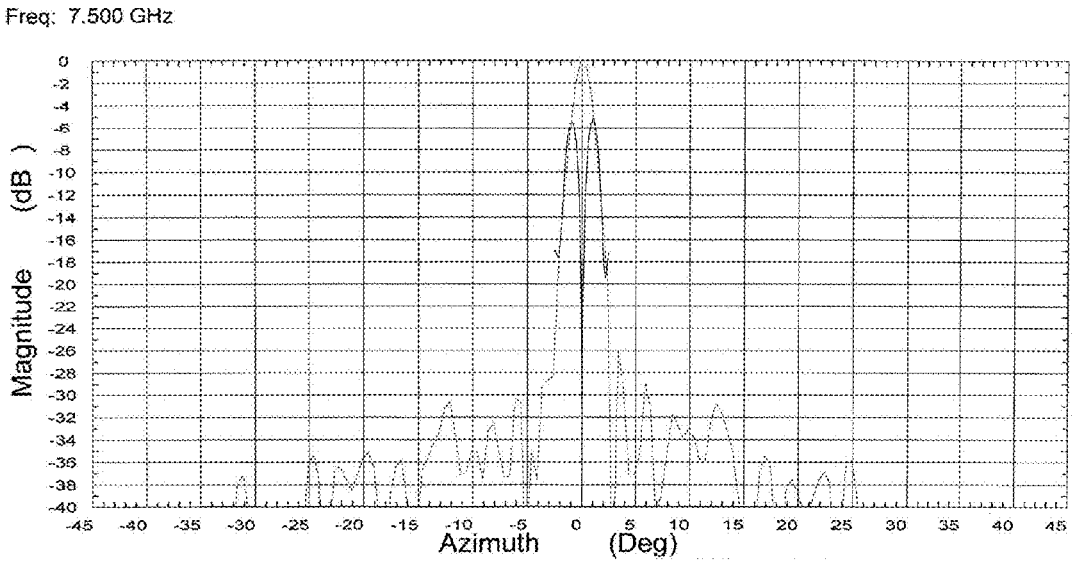
Figure 14D:
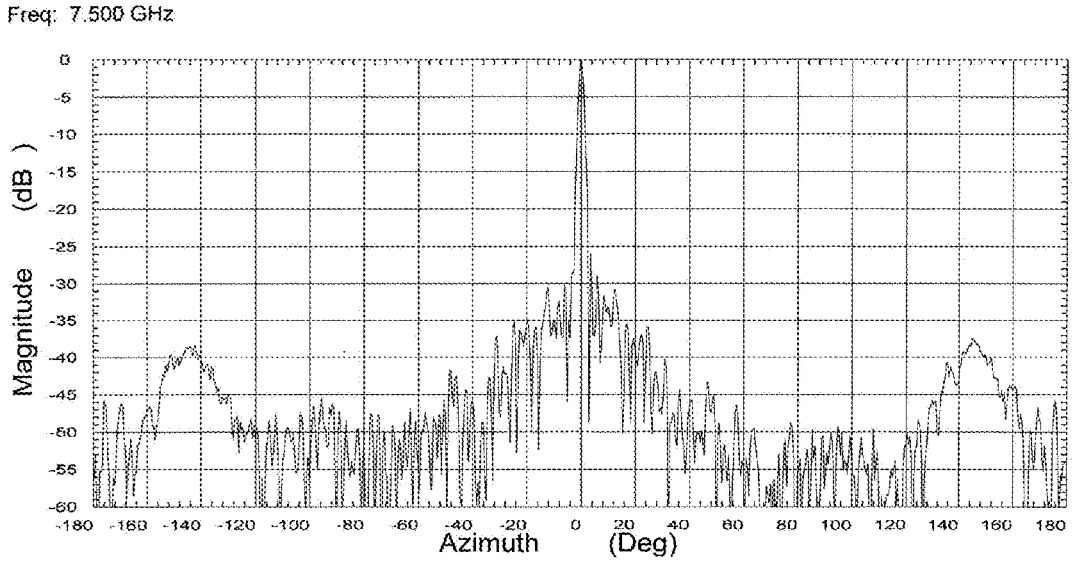
Figure 14E:
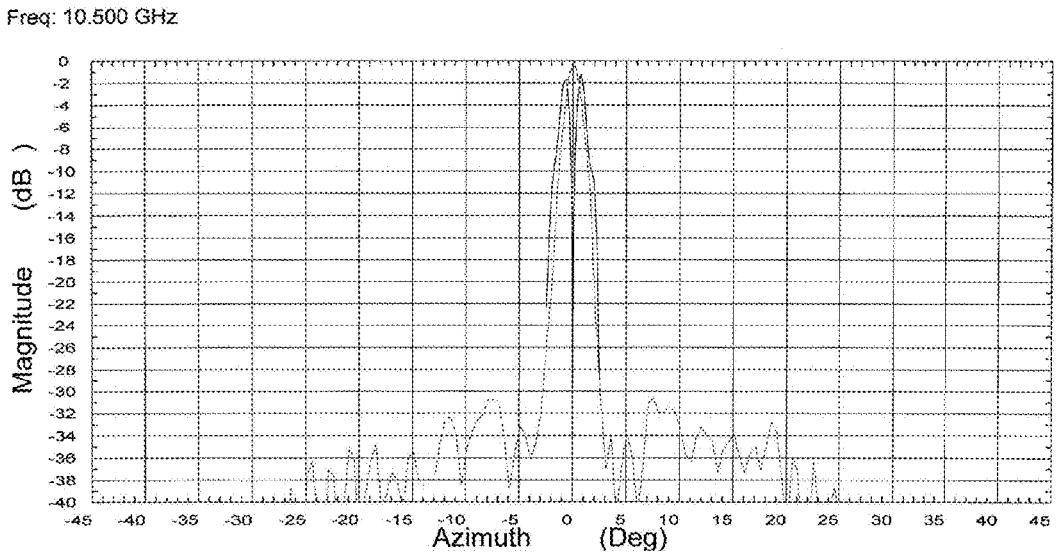
Figure 14F:
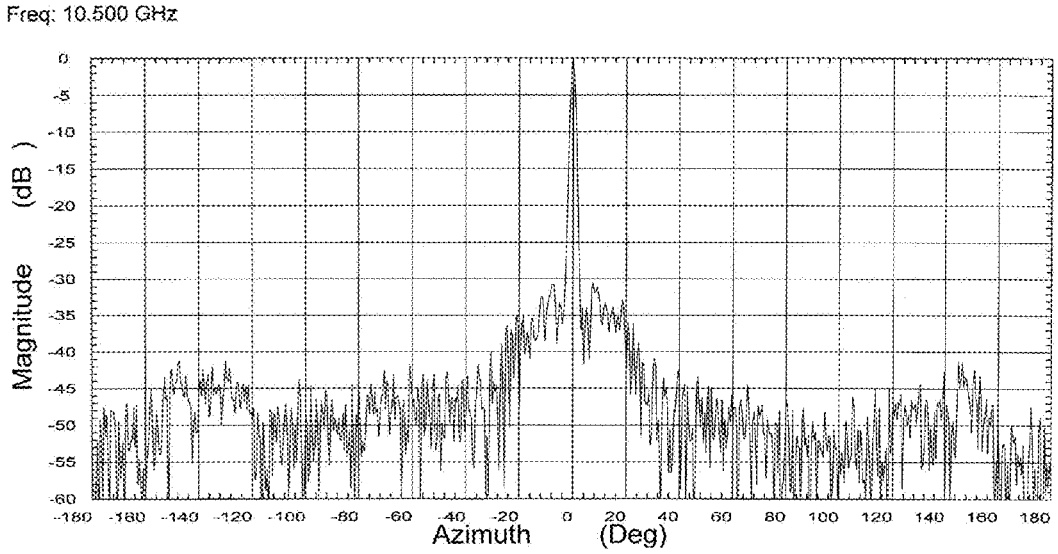

FIGS. 14A-F are diagrams of antenna patterns for an exemplary antenna. The antenna patterns are from the exemplary antenna feed described with reference to FIGS. 1-8 with an offset reflector. FIGS. 14A-B show antenna patterns at an operating frequency of 5.25 GHz. FIGS. 14C-D show antenna patterns at an operating frequency of 7.5 GHz. FIGS. 14E-F show antenna patterns at an operating frequency of 10.5 GHz. FIGS. 14A, 14C, and 14E show antenna patterns for sum and difference signals over ±45 degrees azimuth. FIGS. 14B, 14D, and 14F show antenna patterns for sum signals over a full 360 degrees azimuth. As seen in FIGS. 14A-F, the phasing and array spacing of the exemplary antenna provide well defined patterns. Additionally, all sidelobes are well attenuated.

Variations of the antenna may be designed for many different applications. A process for the design begins with determining the required operating frequencies for the antenna. Additionally, the desired interface waveguide is determined, for example, based on requirements for electronics to be used with the antenna. A desired array spacing is then determined, for example, based on reflector geometry and a desired beam separation. Waveguide is designed for the horn waveguide sections to operate over the required operating frequencies and fit the desired array spacing. A transition between the interface and horn section waveguides is designed, for example, for a low VSWR over the required operating frequencies. A horn for the antenna is designed to provide desired antenna patterns and a low VSWR. The horn design includes determining the shape, such as length and taper, of ridges in the horn.

The above description of the disclosed embodiments is provided to enable any person skilled in the art to make or use the invention. Various modifications to these embodiments will be readily apparent to those skilled in the art, and the generic principles described herein can be applied to other embodiments without departing from the spirit or scope of the invention. Thus, it is to be understood that the description and drawings presented herein represent a presently preferred embodiment of the invention and are therefore representative of the subject matter which is broadly contemplated by the present invention. It is further understood that the scope of the present invention fully encompasses other embodiments that may become obvious to those skilled in the art and that the scope of the present invention is accordingly limited by nothing other than the appended claims.

What is claimed is:

1. A broadband antenna comprising:

a body comprising:

a first waveguide path having a rectangular cross-section including a first longer wall and a second longer wall with a first ridge extending inward from the first longer wall and a second ridge extending inward from the second longer wall, the first waveguide path arranged for coupling electromagnetic signals to electronics at a first end and arranged for coupling to radiating signals at a second end; and a second waveguide path having a rectangular cross-section including a first longer wall and a second longer wall with a first ridge extending inward from the first longer wall and a second ridge extending inward from the second longer wall, the second waveguide path arranged for coupling electromagnetic signals to electronics at a first end, and arranged for coupling to the radiating signals at a second end; and a horn for transmitting and receiving the radiating signals, the horn coupled to the first waveguide path and to the second waveguide path, and comprising:

an upper horn wall comprising a plate with a first horn ridge extending from a base of the horn and projecting toward an inner region of the horn and a second horn ridge extending from the base of the horn and projecting toward the inner region of the horn; and a lower horn wall comprising a plate with a first horn ridge extending from the base of the horn and projecting toward the inner region of the horn and a second horn ridge extending from the base of the horn and projecting toward the inner region of the horn.

2. The antenna of claim 1, wherein:

the first horn ridge of the upper horn wall aligns with the first ridge of the first waveguide path at the second end of the first waveguide path;

the second horn ridge of the upper horn wall aligns with the first ridge of the second waveguide path at the second end of the second waveguide path;

the first horn ridge of the lower horn wall aligns with the second ridge of the first waveguide path at the second end of the first waveguide path; and the second horn ridge of the lower horn wall aligns with the second ridge of the second waveguide path at the second end of the second waveguide path.

3. The antenna of claim 1, the first horn ridge of the upper horn wall, the second horn ridge of the upper horn wall, the first horn ridge of the lower horn wall, and the second horn ridge of the lower horn wall are symmetrically disposed about a central axis of the horn.

4. The antenna of claim 1, wherein the first horn ridge of the upper horn wall and the second horn ridge of the upper horn wall are parallel, and wherein the first horn ridge of the lower horn wall and the second horn ridge of the lower horn wall are parallel.

5. The antenna of claim 4, wherein the first horn ridge of the upper horn wall and the second horn ridge of the upper horn wall are spaced by less than about one-half wavelength, and wherein the first horn ridge of the lower horn wall and the second horn ridge of the lower horn wall are spaced by less than about one-half wavelength.

6. The antenna of claim 1, wherein:

the first horn ridge of the upper horn wall tapers into an inner surface of the upper horn wall as the first horn ridge extends from the base of the horn;

the second horn ridge of the upper horn wall tapers into the inner surface of the upper horn wall as the second horn ridge extends from the base of the horn;

the first horn ridge of the lower horn wall tapers into an inner surface of the lower horn wall as the first horn ridge extends from the base of the horn; and the second horn ridge of the lower horn wall tapers into the inner surface of the lower horn wall as the second horn ridge extends from the base of the horn.

7. The antenna of claim 1, wherein the plate of the upper horn wall is rectangular, and wherein the plate of the lower horn wall is rectangular.

8. The antenna of claim 1, wherein the plate of the upper horn wall and the plate of the lower horn wall diverge at an angle of about 40 degrees.

9. The antenna of claim 1, wherein the horn does not include H-plane walls.

10. The antenna of claim 1, wherein the cross-section of the first end of the first waveguide path and the cross-section of the first end of the second waveguide path match a standard waveguide.

11. The antenna of claim 1, wherein the first waveguide path includes a first transition waveguide section arranged for reducing a cross-section of the first end of the first waveguide path to a cross-section of the second end of the first waveguide path, and wherein the second waveguide path includes a second transition waveguide section arranged for reducing a cross-section of the first end of the second waveguide path to a cross-section of the second end of the first waveguide path.

12. The antenna of claim 11, wherein the first transition waveguide section and the second transition waveguide section are collinear.

* * * * *